United States Patent [19]

Stevens

[11] 4,191,133

[45] Mar. 4, 1980

[54] VAPOR GENERATING SYSTEM UTILIZING INTEGRAL SEPARATORS AND ANGULARLY ARRANGED FURNACE BOUNDARY WALL FLUID FLOW TUBES HAVING RIFLED BORES

[75] Inventor: William D. Stevens, North Caldwell, N.J.

[73] Assignee: Foster Wheeler Energy Corporation, Livingston, N.J.

[21] Appl. No.: 849,273

[22] Filed: Nov. 7, 1977

[51] Int. Cl.[2] ..... F22B 21/34

[52] U.S. Cl. ..... 122/235 R; 122/6 A; 122/406 R; 165/179

[58] Field of Search ..... 122/6 A, 235 R, 406 R, 122/406 S, 512; 165/133, 179

[56] References Cited

U.S. PATENT DOCUMENTS

| | | | |
|---|---|---|---|
| 2,279,548 | 4/1942 | Bailey | 122/235 |
| 3,217,799 | 11/1965 | Rodgers | 165/179 |
| 3,400,689 | 9/1968 | Bagley et al. | 122/510 |
| 3,789,806 | 2/1974 | Gorzegno | 122/406 |
| 3,832,979 | 9/1974 | Ammann | 122/6 A |
| 3,868,927 | 3/1975 | Losel | 122/6 |

*Primary Examiner*—Edward G. Favors

*Attorney, Agent, or Firm*—Marvin A. Naigur; John E. Wilson; John J. Herguth, Jr.

[57] ABSTRACT

A vapor generating system in which a vapor generating section and a superheating section are connected in a series flow relationship. The vapor generating section includes an upright furnace section formed by a plurality of tubes, a portion of which extend at an angle with respect to the horizontal plane for passing fluid through the length of the furnace section to convert a portion of the fluid to vapor or to heat the fluid. The angularly extending portion of each tube has a rifled bore.

13 Claims, 7 Drawing Figures

VAPOR GENERATING SYSTEM UTILIZING INTEGRAL SEPARATORS AND ANGULARLY ARRANGED FURNACE BOUNDARY WALL FLUID FLOW TUBES HAVING RIFLED BORES

BACKGROUND OF THE INVENTION

This invention relates to a vapor generating system and more particularly to a sub-critical or supercritical once-through vapor generating system for converting water to vapor.

In general, a once-through vapor generator operates to circulate a pressurized fluid, usually water, through a vapor generating section and a superheating section to convert the water to vapor. In these arrangements, the water entering the unit makes a single pass through the circuitry and discharges through the superheating section outlet of the unit as super-heated vapor for use in driving a turbine, or the like.

Although these arrangements provide several improvements over conventional drum-type boilers, some problems have arisen in connection with starting up the generators, usually stemming from fluid at an undesirable quantity or condition being passed to the components of the system, resulting in excessive thermal losses, as well as mismatching of temperature of the throttle steam to the turbine inlet causing a decrease in turbine component life.

Earlier attempts to solve some of these problems included arrangements providing bypass circuitry for a portion of the fluid at a point in the flow circuitry between the vapor generating and superheating sections and/or between the superheating section and the turbine during start-up to apportion flow within the system and yet avoid the possibility of fluid at an undesirable quantity or condition being passed to the turbine. However, these arrangements resulted in very poor heat recovery, and, therefore, operate at a reduced thermal efficiency and, moreover, resulted in relatively unsuitable turbine throttle vapor conditions for rolling and bringing the turbine up to speed prior to loading.

Attempts to alleviate the latter problems included installing a division valve in the main flow path to divert flow to a bypass circuit including a flash tank separator located between the vapor generating section and the superheating section, or between a primary and finishing superheater in the superheating section. In these arrangements, the flash vapor from the separator is furnished to the superheating section or to the finishing superheater, and the drains from the separator are passed to a deaerator and/or high pressure heater. However, in these systems, the separator could often accommodate only a limited pressure, which was considerably less than the full operating pressure of the main pressure parts. Therefore, after start-up when turbine demands approaches pressures exceeding the design pressure of the separator, the separator had to be switched out of operation and flow to the turbine supplied directly from the main flow line upstream of the flash tank. However, this switch of flow often caused control difficulties and, in addition, caused a drop in enthalpy at the turbine since the flow source switched from a saturated vapor from the separator to a lower enthalpy water-vapor mixture from the main flow line. Therefore, in order to avoid pressure excursions and an uncontrolled significant temperature drop at the turbine throttle, the valve controlling flow to the turbine directly from the main flow line had to be opened very slowly, the firing rate had to be increased, and the separator outlet valve closed to slowly transfer the sources of turbine steam from the separator to the main flow line. This of course, resulted in a considerable expenditure of time and energy, and a considerable sophistication of controls.

Also, in these latter arrangements, when vapor formed in the separator in response to a start-up firing rate input, the vapor, in addition to flowing to the turbine, was routed to other areas of the system such as high pressure heaters and/or the condenser until a percentage of the final turbine load was achieved. Therefore, these arrangements required the use and operation of several valves which added to the labor and costs in the operation of the system.

In order to overcome the foregoing problem, it has been suggested to provide a separator or separators directly in the main flow line between the vapor generating section and the superheating section. However, some of these arrangements have proven to be costly due to the fact that a relatively large, thick walled separator, and associated components, have to be used. Also, in some of these arrangements the vapor initially formed in the separator is passed in a circuit bypassing the finishing superheater and the turbine during start-up, after which the flow is switched to the superheater and turbine, which also requires a control system utilizing a number of valves. In order to alleviate the latter problems, the system disclosed in U.S. Pat. No. 4,099,384, issued July 11, 1978, and assigned to the assignee of the present invention, includes a plurality of separators disposed in the main flow line between the vapor generating section and the superheating section and adapted to receive fluid flow from the vapor generating section during start-up and full load operation of the system. In this arrangement, the boundary walls of the furnace section of the generator are formed by a plurality of vertically extending tubes having fins extending outwardly from diametrically opposed portions thereof with the fins of adjacent tubes being connected together to form a gas-tight structure. During start-up the furnace operates at constant pressure and supercritical water is passed through the furnace boundary walls in multiple passes to gradually increase its temperature. The system requires the use of headers between the multiple passes to mix out heat unbalances caused by portions of the vertically extending tubes being closer to the burners than others or receiving uneven absorption because of local slag coverage, burners out of service, and other causes. The use of these intermediate headers, in addition to being expensive, makes it undesirable to operate the furnace at variable pressure because of probability of separation of the vapor and liquid phases within the header and uneven distribution to the downstream circuit. Still further, this type of arrangement requires a pressure reducing station interposed between the furnace outlet and the separators to reduce the pressure to predetermined values, and, in addition requires a relatively large number of downcomers to connect the various passes formed by the furnace boundary wall circuitry.

U.S. Pat. No. 4,116,168, issued Sept. 26, 1978 and assigned to the assignee of the present invention, discloses a vapor generating system designed to overcome the latter problems. In this system a start-up arrangement is provided which does not require the use of bypass circuitry incorporating a low pressure flash tank separator.

To achieve this a plurality of separators are utilized which together operate at full system pressure and thus eliminate the need for a relatively large, thick-walled separator, while enabling the turbine to be smoothly loaded at pressures and temperatures that constantly and gradually increase. The separators are connected in the fluid flow circuitry in a series flow relation with said vapor generating section and the superheating section for receiving fluid from the vapor generating section during start-up and full load operation of the system and separating the fluid into a liquid and a vapor for the start-up and low load operation. The separated vapor is passed in the fluid flow circuitry to the superheating section, and drain liquid flow circuit means are connected to the separating means for passing the liquid from the separating means. The vapor generating section includes a furnace section the walls of which are formed by a plurality of tubes having fins extending outwardly from diametrically opposed portions thereof, with the fins of adjacent tubes being connected together to form a gas-tight structure. A portion of the latter tubes extend at an acute angle with respect to a horizontal plane.

The disposition of the separator in the main flow circuit results in the elimination of bypass circuitry and valving. Also the use of the angularly extending tubes which wrap around to form the intermediate furnace section enables the fluid to average out furnace heat unbalances and be passed through the boundary walls of the furnace section in one complete pass, thus eliminating the use of multiple passes and their associated mix headers and downcomers. Also, as a result of the angularly extending tubes, a relatively high mass flow rate and large tube size can be utilized over that possible with vertical tube arrangements.

This arrangement, although resulting in the foregoing advantages, is not without problems. For example, since the boiler operates at variable pressure, which extend up to and through 2400–3000 psi range, it is important that a phenomenon known as nucleate boiling is maintained. Nucleate boiling is characterized by the formation and release of steam bubbles on the inside of the heat absorbing surface of the tubes with the water still wetting the surface. The latter is important since the wall metal temperature of a tube will not rise substantially above the temperature of the contained fluid enough to weaken or otherwise damage the tube so long as the tube is wet with water on the inner wall surface opposite the heat receiving outer surface, i.e., as long as nucleate boiling is taking place, even with high heat transfer rates through the metal of the tube wall due to the contact of hot gases and/or radiation from a furnace. However, in the relatively high pressure range set forth above, the desirable nucleate boiling in high heat flux zones tends to be replaced by what is commonly known as "film boiling", in which a steam film forms over the heat transfer surface and prevents the liquid from wetting the surface. The steam film thus acts as a layer of insulation which retards the heat being transferred from the heat absorbing surface to the water and therefore the metal temperature of the tube increases rapidly. The resulting metal temperature may be high enough to cause an immediate tube failure and if not, it promotes corrosion which can eventually cause the tube to fail. Therefore, it is especially important in these types of arrangements to insure that nucleate boiling is maintained during all operating conditions of the boiler. In the boiler disclosed in the latter cited application departure from nucleate boiling may be avoided if a relatively high fluid mass flow rate is maintained through the boiler.

Also in the boiler discussed above, the relatively high mass flow rate must be maintained at low loads since the angularly extending tubes promote separation of the steam and water phases during flow through the tubes—a decided disadvantage in these types of arrangements.

However, the maintenance of the high mass flow rates for the above reasons is not without problems since it results in a higher pressure drop across the circuit and requires the use of relatively small diameter tubes.

SUMMARY OF THE INVENTION

It is therefore an object of the present invention to provide a vapor generating system which includes the advantages of utilizing a plurality of separators in the main flow line and angularly extending tubes which wrap around to form a portion of the furnace section of the boiler yet overcomes the above-identified problems.

It is a further object of the present invention to provide a vapor generating system of the above type which operates at variable pressure including pressures of a relatively high value yet maintains nucleate boiling.

It is a still further object of the present invention to provide a vapor generating system of the above type in which nucleate boiling is maintained without having to resort to relatively high mass flow rates through the flow circuit.

It is a still further object of the present invention to provide a vapor generating system of the above type in which steam and water phases are maintained in an unseparated state while permitting the boiler to go down to relatively low minimum loads and flow rates without the danger of separation of steam and water phases.

It is a still further object of the present invention to provide a vapor generating system of the above type in which at least a portion of each of the tubes in a furnace section of the boiler is provided with rifled bores.

Toward the fulfillment of these and other objects, the system of the present invention includes a vapor generating section, a superheating section, and fluid flow circuitry connecting said sections, said vapor generating section comprising an upright furnace section the boundary walls of which are formed by a plurality of tubes and means for passing fluid through said tubes to apply heat to said fluid, at least a portion of said tubes extending at an acute angle with respect to a horizontal plane, and at least a portion of the length of said tubes having a rifled bore.

BRIEF DESCRIPTION OF THE DRAWINGS

The above brief description, as well as further objects, features, and advantages, of the present invention will be more fully appreciated by reference to the following detailed description of a presently preferred but nonetheless illustrative embodiment in accordance with the present invention, when taken in connection with the accompanying drawings wherein.

DESCRIPTION OF THE PREFERRED EMBODIMENTS

Figure 1:
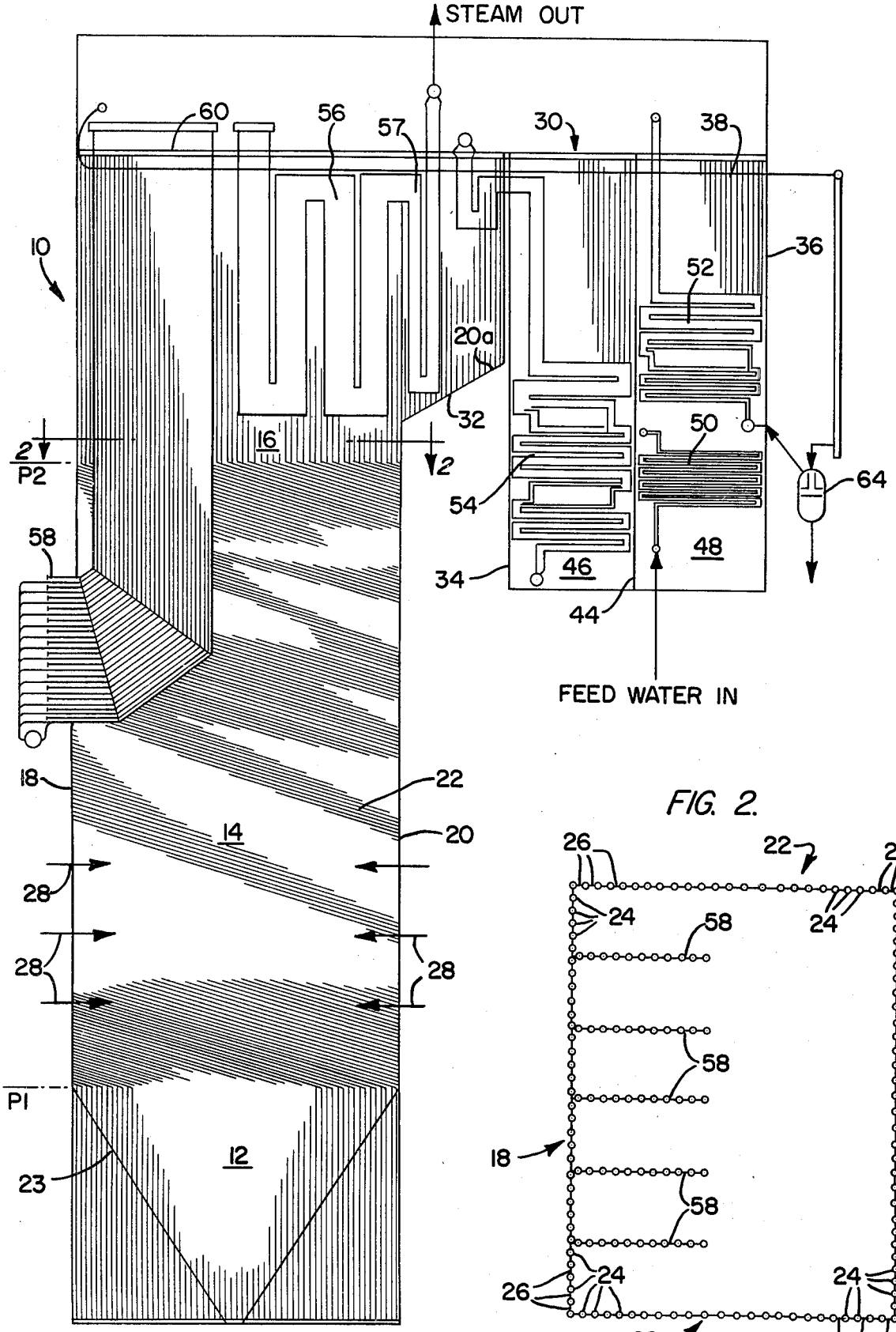
FIG. 1 is a schematic sectional view of the vapor generatiang system of the present invention.

Referring specifically to FIG. 1 of the drawings, the reference numeral 10 refers in general to a vapor generator utilized in the system of the present invention and including a lower furnace section 12, an intermediate furnace section 14, and an upper furnace section 16. The boundary walls defining the furnace sections 12, 14 and 16 include a front wall 18, a rear wall 20 and two side walls extending between the front and rear wall, with one of said side walls being referred to by the reference numeral 22. The lower portions of the front wall 18 and the rear wall 20 are sloped inwardly to form a hopper section 23 at the lower furnace section 12 for the accumulation of ash, and the like, in a conventional manner.

Figure 2:
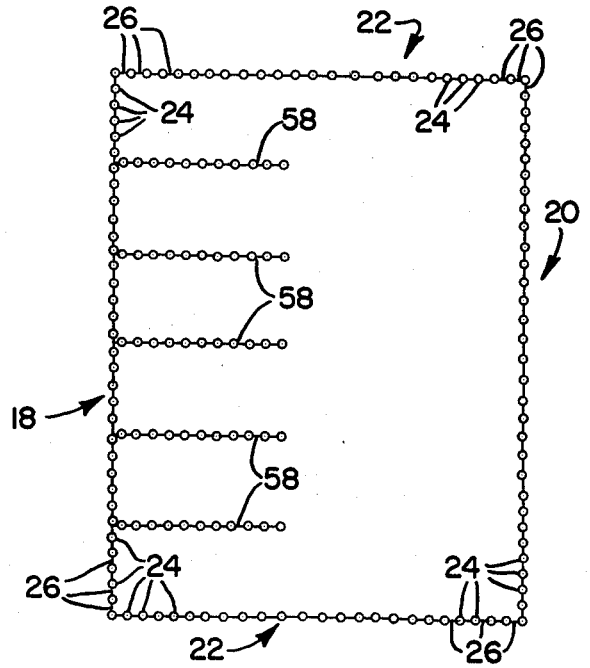
FIG. 2 is a sectional view taken along the line 2—2 of FIG. 1.

As shown in FIG. 2, each of the walls 18, 20 and 22 are formed of a plurality of tubes 24 having continuous fins 26 extending outwardly from diametrically opposed portions thereof, with the fins of adjacent tubes being connected together to form a gas-tight structure.

Figure 3:
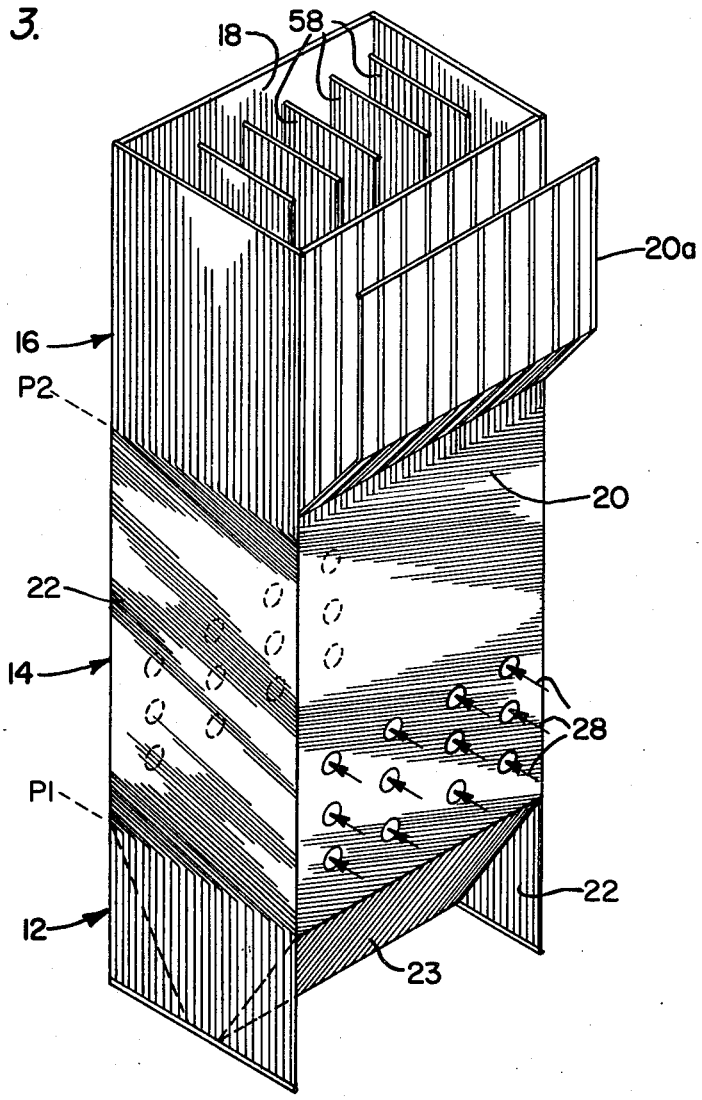
FIG. 3 is a partial perspective view of a portion of the vapor generating system of the present invention.

Referring specifically to FIGS. 1 and 3, the tubes in the side walls 22 of the lower furnace section 12 extend in a vertical fashion up to a horizontal plane P1 located at the upper portion of the hopper section 23. The tubes 24 forming the walls 18, 20 and 22 in the intermediate section 14 extend from the plane P1 to a plane P2 disposed in the upper portion of the vapor generator 10, with these tubes extending at an acute angle with respect to the planes P1 and P2. The tubes 24 forming the walls 18, 20, and 22 of the upper furnace section 16 extend in a vertical direction from the plane P2 to the top of the latter section.

The tubes 24 in the intermediate section 14 extend from plane P1 and wrap around for the complete perimeter of the furnace at least one time to form the walls 18, 20, and 22 before they terminate at plane P2. Tubes having approximately the same diameter are utilized throughout the three furnace sections 12, 14, and 16 and bifurcations are provided at the planes P1 and P2 so that each angularly extending tube 24 in the intermediate furnace section 14 bifurcates into two vertically extending tubes in the upper furnace section 16. In a similar manner each tube 24 in the intermediate section 14 bifurcates into two vertically extending tubes in the side walls 22 of the hopper section 12, with the tubes 24 of the front wall 18 and the rear wall 20 extending at an angle to form the hopper slope. The above-mentioned bifurcations form no part of the present invention and are the subject of a co-pending application filed by Harry H. Pratt and David Cranstoun on (attorney's docket A-10,995).

Figure 4:
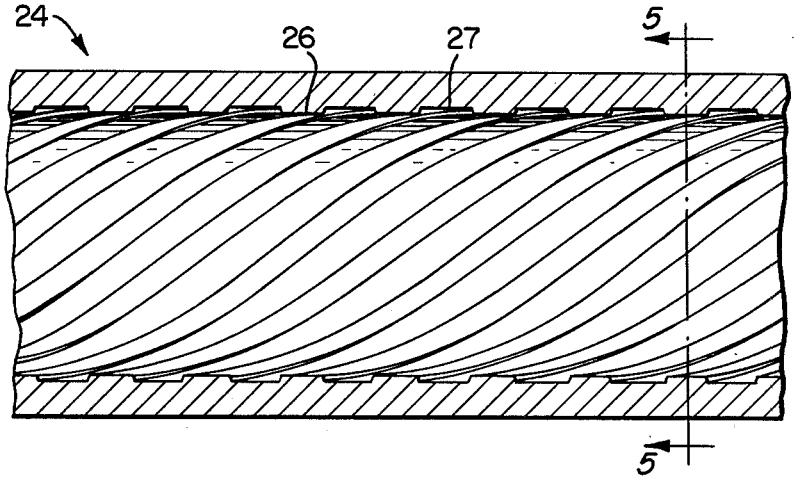
FIG. 4 is a longitudinal sectional view of an internally ribbed tube utilized in the system of FIGS. 1–3.
Figure 5:
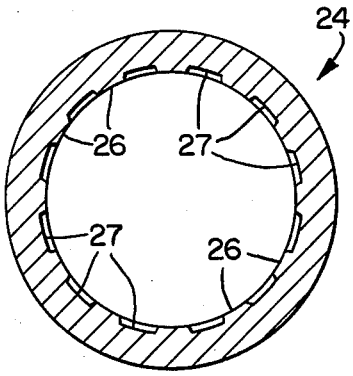
FIG. 5 is a vertical sectional view taken along the line 5—5 of FIG. 4.

According to one of the main features of the present invention that portion of each of the tubes 24 extending in the intermediate furnace section 14 has a rifled bore formed by a plurality of ribs formed on the internal wall of the tube and extending in a spiral fashion throughout the length of the tube. Referring specifically to FIGS. 4 and 5 which depicts a portion of a tube 24 extending in the intermediate section 14 of the furnace section, it is noted that a plurality of ribs 26 are provided on the internal wall of the tube and extend in a spiral fashion for the length thereof. The ribs 26 are spaced apart to define a plurality of spirally extending grooves 27 extending between adjacent ribs. According to a preferred embodiment twelve ribs 26 are provided on each tube which extend around the circumference of the tube thus defining twelve grooves 27. Also, the pitch, or the distance between corresponding points of consecutive ribs measured parallel to the tube axis is 1.0 inch plus or minus 0.25 inches and the width of each rib is 0.25 to 0.3 inches. The height of each rib is 0.05 to 0.06 inches, with a minor tube diameter in the range of approximately 0.85 to 1.25 inches, giving an L/d ratio ranging from approximately 10 to 15 (L is the lead of the rifling and is defined as the pitch multiplied by the number of ribs).

The provision of the rifled bored tubes in the intermediate furnace section 14 enables the system to be operated without departing from nucleate boiling as described above yet enables the boiler to operate at relatively low mass flow rates.

Referring again to FIGS. 1 and 3, the upper portion of the rear wall 20 in the upper section 16 has a branch wall **20*a* which is formed by bending a selected number of tubes 24 from the rear wall 20 outwardly in a manner to define spaces between the remaining tubes 24 in the wall 20 and between the tubes forming the branch wall 20*a* to permit combustion gases to exit from the upper furance section 16**, as will be described later.

A plurality of burners 28 are disposed in the front and rear walls 18 and 20 in the intermediate furnace section 14, with the burners being arranged in this example in three vertical rows of four burners per row. The burners 28 are shown schematically since they can be of a conventional design.

A heat recovery area including a vestibule and convection section, shown in general by the reference numeral 30, is provided in gas flow communication with the upper furnace section 16 and includes a vestibule floor 32 defined in part by portions of the tubes 24 forming the branch wall **20*a*. The convection section of heat recovery area 30 also includes a front wall 34 which extends upwardly and forms a screen to match vertical portions of the tubes of the branch wall 20*a*, a rear wall 36 and two side walls 38 one of which is shown in FIG. 1. It is understood that the vestibule floor 32 is rendered gas-tight and that the front wall 34 and rear wall 36 of the convection section of the heat recovery area 30 are formed of a plurality of vertically extending, interconnected tubes 24 in a similar manner to that of the upper furnace section 16**.

A partition wall 44, also formed by a plurality of interconnected tubes 24, is provided in the vestibule-heat recovery area 30 to divide the latter into a front gas pass 46 and a rear gas pass 48. An economizer 50 is disposed in the lower portion of the rear gas pass 48, a primary superheater 52 is disposed immediately above the economizer, and a bank of reheater tubes 54 is provided in the front gas pass 46.

A platen superheater 56 is provided in the upper furnace section 16 and a finishing superheater 57 is provided in the vestibule portion of the vestibule-heat recovery area 30 in direct fluid communication with the platen superheater 56.

A plurality of division walls 58 are provided with each having a portion disposed adjacent the front wall 18. The division walls 58 penetrate a portion of the tubes 24 of the latter wall in the intermediate furnace section 14, and extend upwardly within the upper furnace section 16 as shown in FIGS. 1 and 3.

The upper end portions of the walls 18, 20 and 22, the branch section 20*a*, and the division walls 58, as well as the partition wall 44, side walls 38 and rear wall 36 of the vestibule-heat recovery area 30 all terminate in substantially the same general area in the upper portion of the vapor generating section 10.

A roof 60 is disposed in the upper portion of the section 10 and consists of a plurality of tubes 24 having fins 26 connected in the manner described above but extending horizontally from the front wall 18 of the furnace section to the rear wall 36 of the vestibule-heat recovery area 30.

It can be appreciated from the foregoing that combustion gases from the burners 28 in the intermediate furnace section 14 pass upwardly to the upper furnace section 16 and through the vestibule-heat recovery area 30 before exiting from the front gas pass 46 and the rear gas pass 48. As a result, the hot gases pass over the platen superheater 56, the finishing superheater 57 and the primary superheater 52, as well as the reheater tubes 54 and the economizer 50, to add heat to the fluid flowing through these circuits.

Although not shown in the drawings for clarity of presentation, it is understood that suitable inlet and outlet headers, downcomers and conduits, are provided to place the tubes 24 of each of the aforementioned walls and heat exchangers as well as the roof 60 in fluid communication to establish a flow circuit that will be described in detail later.

A plurality of separators 64 are disposed in a parallel relationship adjacent the rear wall 36 of the vestibule-heat recovery area 30 and are disposed directly in the main flow circuit between the roof 60 and the primary superheater 52. The separators 64 may be identical to those described in the above mentioned patent application Ser. No. 713,313 and operate to separate the fluid from the roof 60 into a liquid and vapor. The vapor from the separators 64 is passed directly to the primary superheater 52 and the liquid is passed to a drain manifold and heat recovery circuitry for further treatment as also disclosed in the latter mentioned application.

Figure 6:
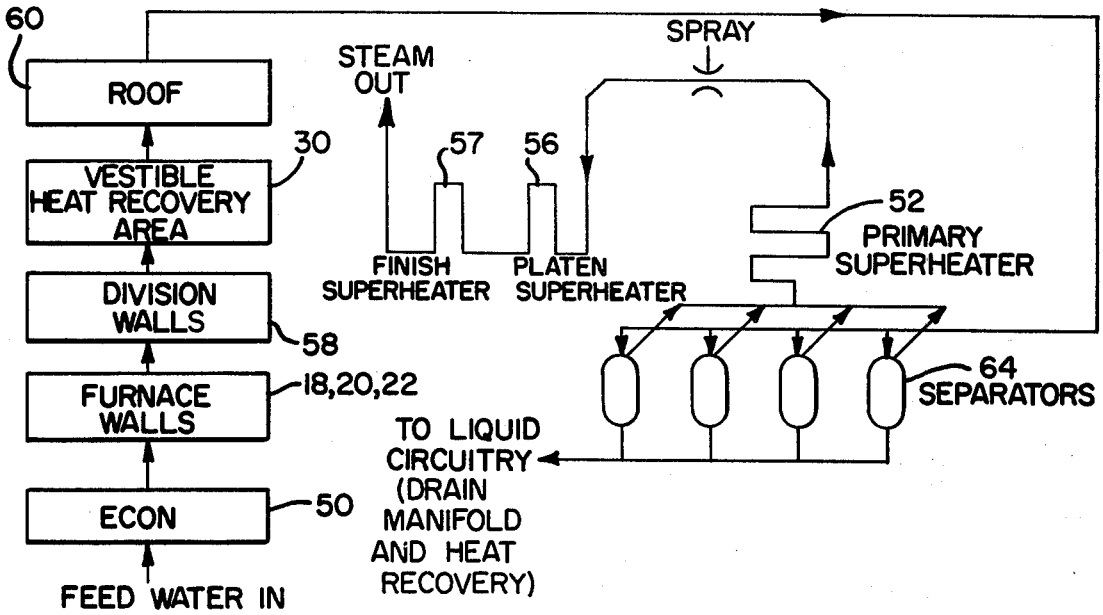
FIG. 6 is a schematic diagram depicting the flow circuit of the vapor generating system of the present invention.

The fluid circuit including the various components, passes and sections of the vapor generating section of FIG. 1 is shown in FIG. 6. In particular, feedwater from an external source is passed through the economizer tubes 50 to raise the temperature of the water before it is passed to inlet headers (not shown) provided at the lower portions of the furnace walls 18, 20 and 22. All of the water flows upwardly and simultaneously through the walls 18, 20 and 22 to raise the temperature of the water further to convert as least a portion of same to vapor, before it is collected in suitable headers located at the upper portion of the vapor generator 10. The fluid is then passed downwardly through a suitable downcomer, or the like and then upwardly through the division walls 58 to add additional heat to the fluid. The fluid is then directed through the walls 34, 36, 38 and 44 of vestibule-heat recovery area 30 after which it is collected and passed through the roof 60. From the roof 60, the fluid is passed via a suitable collection header, or the like, to the separators 64 which separate the vapor portion of the fluid from the liquid portion thereof. The liquid portion is passed from the separators to a drain manifold and heat recovery circuitry (not shown) for further treatment, and the vapor portion of the fluid in the separators 64 is passed directly into the primary superheater 52. From the latter, the fluid is spray attemperated after which it is passed to the platen superheater 56 and the finishing superheater 57 before it is passed in a dry vapor state to a turbine or the like.

Figure 7:
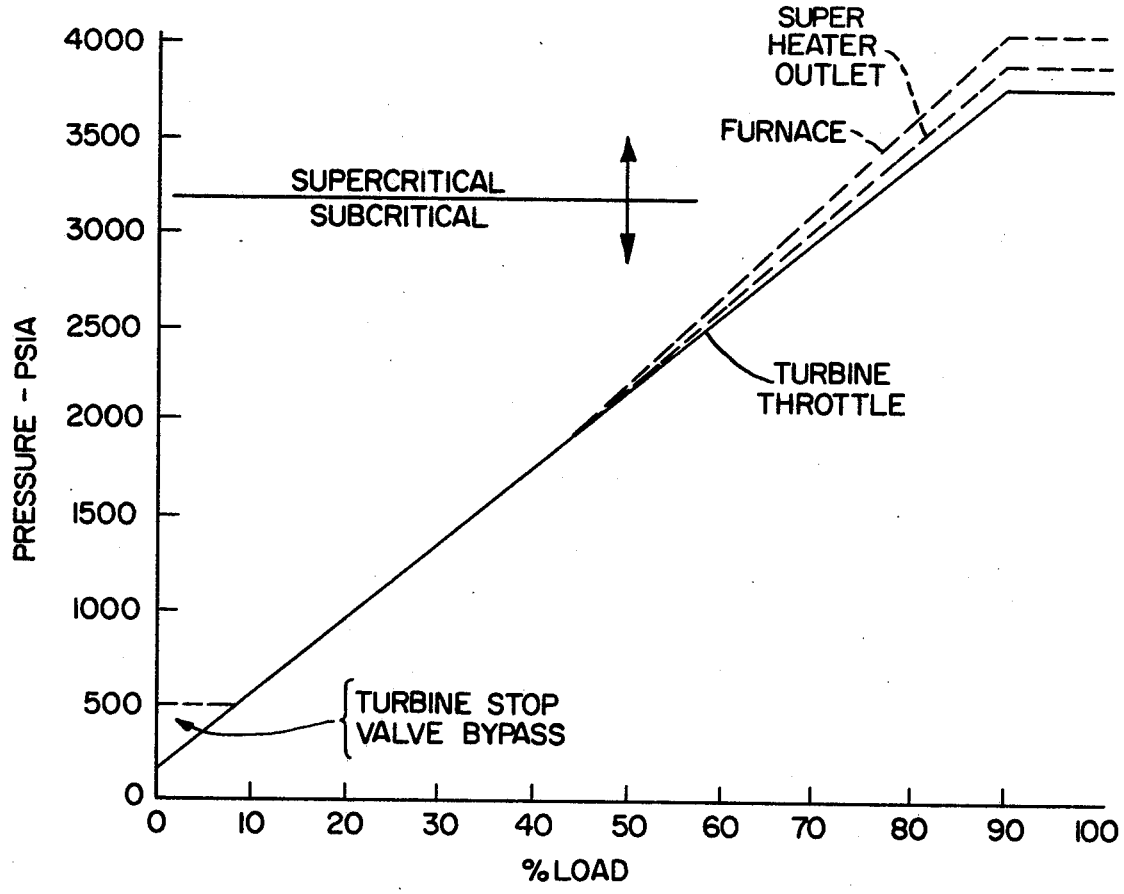
FIG. 7 is a graph illustrating the relationship of throttle pressure versus load for a vapor generator in accordance with the concepts of the present invention.

Referring to FIG. 7, the operation of the vapor generator of the present invention is such that the turbine throttle pressure is increased in response to load demand. A minimum vapor generator circuitry pressure is held to approximately 500 p.s.i. In the range between 12 percent load and 100 percent load, the fluid pressure within the vapor generator circuitry varies essentially in step with the throttle pressure. Below about 12 percent load, the flow to the turbine is throttled through a turbine stop valve bypass. The transition from subcritical to super-critical flow in the generator circuitry in ramping from 500 p.s.i to 3500 p.s.i. (12 percent load to 100 percent load) occurs at 3206 p.s.i. It should be understood that the above values for load vs. pressure are typical only, and may vary depending upon the specific design of the vapor generator. The significant feature is that the vapor generator employs a true variable pressure operation. In addition, the pressures in the furnace circuitry are substantially the same as those in the other pressure parts of the generator, allowing for normal pressure losses, and no pressure breakdown is employed between the furnace circuitry and such other pressure parts.

Several important advantages result from the foregoing arrangement. For example, the vapor generator of the present invention can operate at relatively high pressures yet will maintain nucleate boiling without having to resort to relatively high mass flow rates through the flow circuit. Also the vapor generator of the present invention can go down to relatively low minimum loads and corresponding low flow rates without the danger of separation of the steam and water phases of the fluid. These advantages of course are in addition to those obtained with the use of the separators provided in the main flow circuit and operating at full system pressure, and the use of tubes which extend at an acute angle with respect to horizontal plane.

It is understood that while the preferred embodiment described above includes a furnace having a substantially rectangular shaped cross-sectional area, other cross-sectional configurations such as those having a circular or elliptical pattern may be utilized as long as the angular tube arrangement is maintained. For example, the furnace may have a helical configurations in a pattern conforming to the cross-sectional shape of the furnace. (In this context, it should be noted that the type of boiler covered by the present invention in which the tubes are angularly arranged in the furnace boundary wall is commonly referred to by those skilled in the art as a "helical tube boiler", notwithstanding the fact that a true mathematical helix is not generated in a boiler which has a substantially rectangular cross-sectional area.) It is also understood that the tubes may wrap around the furnace for more than one complete revolution, depending on the overall physical dimensions of the furnace.

It is further understood that portions of the vapor generator 10 have been omitted for the convenience of presentation. For example, insulation and support systems can be provided that extend around the boundary walls of the vapor generator 10 and a wind box or the like may be provided around the burners 28 to supply air to same in a conventional manner. It is also understood that the upper end portions of the tubes 24 forming the upper furnace section 16 and vestibule-heat recovery area 30 can be hung from a location above the vapor generating section 10 to accommodate thermal expansion in a conventional manner.

Also, while according to a preferred embodiment, only those tubes located in the intermediate furnace section 14 are rifled, i.e. have their internal surfaces formed with ribs, it is understood that it is within the scope of this invention to also provide the ribs on the tubes extending in other sections of the vapor generator.

Other modifications, changes and substitutions are intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. A vapor generating system comprising an upright furnace section the boundary walls of which are formed by a plurality of tubes having fins extending outwardly from diametrically opposed portions thereof, with the fins of adjacent tubes being welded together to form a gas-tight structure, burner means associated with said furnace section, said tubes being directly exposed to heat from said burner means for the entire height of said boundary walls, said tubes extending vertically in the plane of each boundary wall in the lower portions and upper portions of said furnace section walls and extending at an acute angle with respect to a horizontal plane in the intermediate portions of said boundary walls extending between said upper and lower portions, at least a portion of each of said tubes having a rifled bore, and means for simultaneously passing said fluid through the tubes of all of said boundary walls to apply said heat to said fluid.

2. The system of claim 1 further comprising a fluid separating section, a superheating section, and fluid flow circuitry connecting said sections in a series flow relationship.

3. The system in claim 2 wherein said fluid separating section receives fluid from said vapor generating section during start-up and full load operation of said system and separates said fluid into a liquid and a vapor.

4. The system of claim 3 wherein said fluid flow circuitry passes the vapor from said separating section to said superheating section during start-up and full load operation of said system.

5. The system of claim 3 wherein said separating section is adapted for connection to liquid flow means for passing the drain liquid from said separating means.

6. The system of claim 1 wherein that portion of each tube in said intermediate portion of said furnace section has said rifled bore.

7. The system of claim 1 wherein said furnace section has a rectangular horizontal cross-section.

8. The system of claim 1 wherein said tubes wrap around the furnace for at least one revolution.

9. A vapor generating system comprising a furnace section the walls of which are formed by a plurality of tubes having fins extending outwardly from diametrically opposed portions thereof, with the fins of adjacent tubes being connected to form a gas-tight structure, said tubes extending vertically in the lower and upper portions of said furnace section and extending at an acute angle with respect to a horizontal plane in an intermediate portion of said furnace section extending between said upper and lower portions, each tube in said intermediate portion of said furnace section bifurcating into at least two tubes in said upper furnace section portion and in said lower furnace section portion, that portion of each tube in said intermediate portion of said furnace section having a rifled bore, means for passing fluid through said tubes, and means for heating said fluid as it passes through said tubes.

10. The system of claim 9 wherein all of said fluid is passed simultaneously through the tubes of all of said walls.

11. The system of claim 9 wherein said furnace section has a rectangular horizontal cross-section.

12. The system of claim 9 wherein said tubes wrap around the furnace for at least one revolution.

13. A vapor generating system comprising a furnace section the walls of which are formed by a plurality of tubes, said tubes extending vertically in the plane of each wall in the lower portions and upper portions of each of said walls and extending at an acute angle with respect to a horizontal plane in the intermediate portions of said walls extending between said upper and lower portions, the tubes in said intermediate portions of said walls having a rifled bore, means for simultaneously passing fluid through said tubes of all of said walls, and means for heating said fluid as it passes through said tubes.

* * * * *